United States Patent [19]

Beretta

[11] 4,388,773

[45] Jun. 21, 1983

[54] LEVER-TYPE CLOSING DEVICE FOR BLOCKING AND UNBLOCKING THE BARREL OF AUTOMATIC, PORTABLE FIREARMS

[75] Inventor: Pier C. Beretta, Gardone V.T., Italy

[73] Assignee: Fabrica D'Armi Pietro Beretta S.p.A., Italy

[21] Appl. No.: 230,435

[22] Filed: Feb. 2, 1981

[30] Foreign Application Priority Data

Mar. 7, 1980 [IT] Italy ..... 5129-A/80

[51] Int. Cl.[3] ..... F41C 21/22

[52] U.S. Cl. ..... 42/75 B

[58] Field of Search ..... 42/75 B, 75 A, 77

[56] References Cited

U.S. PATENT DOCUMENTS

| | | | |
|---|---|---|---|
| 534,691 | 2/1895 | Hepburn | 42/75 B |
| 1,363,262 | 12/1920 | North | 89/193 |
| 2,031,383 | 2/1936 | Mendoza | 42/75 A |

FOREIGN PATENT DOCUMENTS

| | | | |
|---|---|---|---|
| 1446514 | 6/1969 | France | 42/75 B |
| 427165 | 4/1935 | United Kingdom | 42/75 |

*Primary Examiner*—Charles T. Jordan
*Assistant Examiner*—Ted L. Parr
*Attorney, Agent, or Firm*—McGlew and Tuttle

[57] ABSTRACT

A lever-type closing device is provided which permits the assembling and, subsequently, disassembling of a barrel by means of a simple axial or linear displacement of itself. The closing device of this invention also includes means for backwardly displacing the carriage of the weapon and with it the firing pin during the assembling and disassembling of the barrel, means for preventing the closing of the device when the barrel is disassembled so as to leave the weapon in a condition for rapidly accepting a fresh barrel, means for preventing the aiming of the weapon when the closing device is open or when the barrel is not assembled correctly and means for preventing the utilization of the weapon should the barrel be blocked in juxtaposition with the rest of the weapon components.

4 Claims, 7 Drawing Figures

Fig. 1
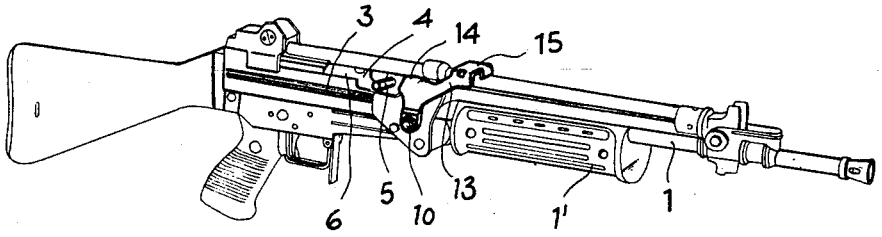
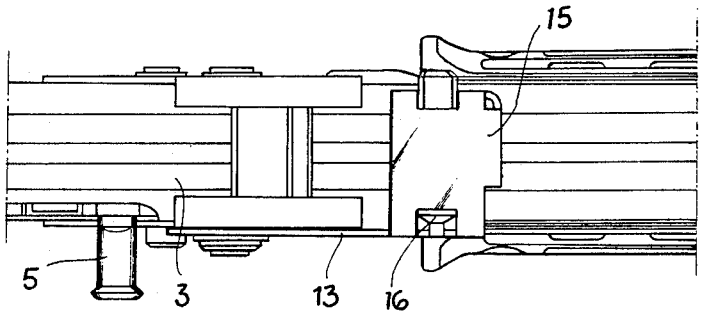
Fig. 2

LEVER-TYPE CLOSING DEVICE FOR BLOCKING AND UNBLOCKING THE BARREL OF AUTOMATIC, PORTABLE FIREARMS

FIELD OF THE INVENTION

The present invention is directed generally to portable firearms and more particularly to a closing device of the lever-type for blocking and unblocking the barrel of automatic portable firearms.

BACKGROUND OF THE INVENTION

During the use of the above mentioned type of firearms, which are meant for rapid and sustained fire, the barrel is subjected to intense heating so that it becomes necessary to disassemble it frequently in order to substitute a new and cold barrel therefor. Such an operation must nevertheless be executed with a maximum simplicity and rapidity so as not to reduce the effective capacity of the weapon.

Already known, for example from U.S. Pat. No. 1,363,262, is a system for removably attaching the barrel to the same automatic portable firearm, which system however does not permit the substitution of an overheated barrel in a manner which is rapid and simple.

In this prior art construction, the assembling and disassembling of the barrel must be effected with a movement which is a combination of a rotational and translational movement of the barrel, so as to detach an arresting tooth which is provided in the rear portion of the barrel, which removal must occur from a recess provided on the frame of the weapon itself. Such a movement of the barrel is always difficult to be carried out, both because of the difficulty of maneuvering and handling the barrel itself when it is overheated and also because of the difficulty of centering the barrel during the assembling thereof due to the fact that the weapon must be held in a firm and steady position. On the other hand the user is forced to modify the normal and conventional position of firing in order to execute this complicated movement of the barrel during the assembling and disassembling operation.

Furthermore, in the arrangements heretofore utilized and known, there is not provided any member or device which might be capable of controlling the position of the carriage and of the firing pin of the weapon during the phase of assembling and disassembling of the barrel and which might be capable of preventing the utilization of the weapon when the barrel is not correctly blocked in place.

BRIEF DESCRIPTION OF THE INVENTION

It is the main object of the present invention to provide a device which permits the mounting and subsequently the dismounting or assembling and subsequently disassembling of a barrel by means of a simple axial or linear displacement of the barrel itself. In this manner, the user can maneuver the barrel of the weapon with ease by means of the very same rod which he is holding during the firing operation. The user furthermore is not compelled to move or modify the normal conventional firing position so that he always remain in position to utilize and target the weapon.

Another object of the present invention is to provide a device with means for backwardly displacing the carriage of the weapon and with it the firing pin during the assembling and the disassembling of the barrel, to prevent the closing of the device when the barrel is disassembled so as to leave the weapon in a condition for rapidly accepting a fresh barrel, to prevent the aiming of the weapon when the closing device is open or when the barrel is not assembled correctly, and to prevent the utilization of the weapon should the barrel be blocked in juxtaposition with the rest of the weapon components.

BRIEF DESCRIPTION OF THE DRAWINGS

These and other objects of the invention will be carried out in conjunction with a description of a practical example of the invention, described with reference to the accompanying drawings, which are indicative of the invention but not limitative thereof, in which;

FIG. 1 is a perspective view of a weapon such as a machine pistol, with a lever-type closing device in accordance with the invention;

FIG. 2 is a fragmentary, top plan view of a portion of the weapon shown in FIG. 1;

DETAILED DESCRIPTION OF THE INVENTION

Figure 3:
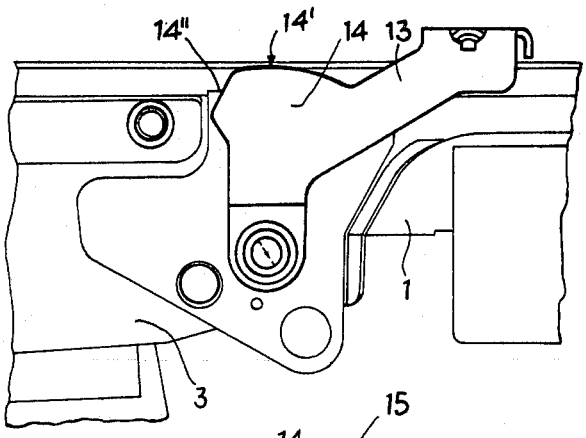
FIGS. 3, 4 and 5 are fragmentary side elevational views of the lever to maneuver the device shown in a closed position, an open position and an intermediate position.

With reference to the accompanying drawings reference character 1 represents the barrel of the weapon which is attached, for example, by means of fasteners such as screws to the breech 2 of the gun and associated removably with the frame 3 of the weapon itself, the barrel 1 being provided with a holding rod 1'. Reference character 4 represents the arming carriage which is well known and conventional and is axially guided in the frame 3. The carriage 4 is provided with a handle 5 which protrudes through a slot 6 from one side of the weapon (in the drawing from the righthand side).

At the base of the breech 2 of the barrel 1 there is provided a semi-cylindrical seat 7, that opens downwardly and which is oriented transversely with respect to the base of the breech 2. The forward end of the seat 7 is defined by a shoulder 8 and the rearward end of the seat 7 is defined by a rib 9 that is smaller in width than the shoulder 8.

Transversely of the frame 3 of the weapon, so as to be in alignment with the semi-cylindrical seat 7 of the breech 2 when the barrel 1 is assembled, there is provided a blocking pin 10 which is capable of rotation about its own longitudinal axis. The pin 10 has at the center thereof a semi-cylindrical full portion 11 which includes a transverse notch 12 that has a width and a depth which are slightly greater than the width and the height, respectively, of the rib 9, so as to permit the passage thereof when the notch 12 is turned toward the semi-cylindrical seat 7 of the barrel 1.

To the blocking pin 10 there is attached a maneuver lever 13 for controlling the rotation of the pin 10 itself. The lever 13 extends upwardly from the same side of the weapon from which the handle 5 of the carriage 4 protrudes. The lever 13 is located in a forward position with respect to the handle 5 and is displaceable angularly toward and away from the handle 5.

Figure 5:
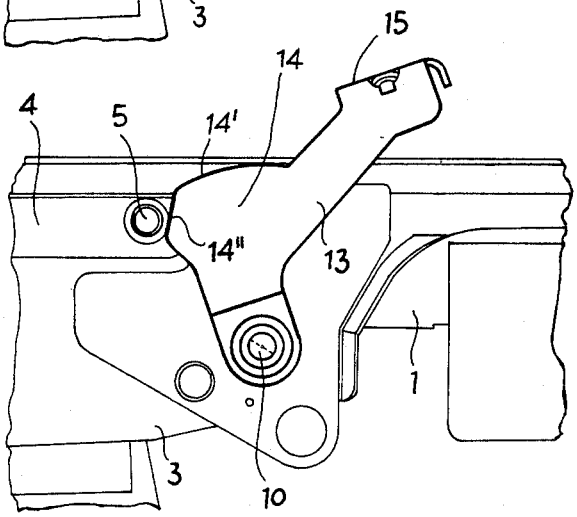
Figure 4:
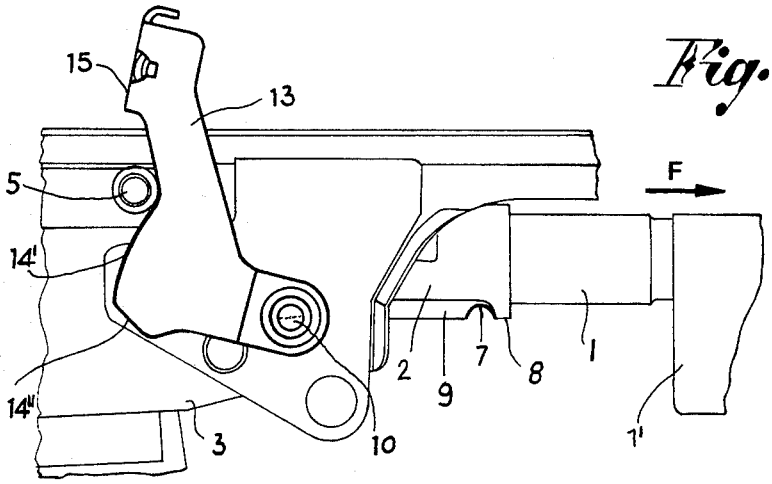

According to a special characteristic of the invention, the maneuver lever 13 has, on its side which faces toward the handle 5 of the carriage 4, a cam portion 14 which has a profile formed by a curved section 14' that is concentric with the rotational axis of the lever 13 or to the axis of the blocking pin 10, and a flat section 14" as shown in FIGS. 3, 4 and 5 of the attached drawings.

The maneuver lever 13 furthermore has an upper terminal portion 15 which extends transversely above the frame 13 of the weapon and carries a spring loaded latch 16 (FIG. 2) which serves to engage the frame of the weapon so as to arrest the lever 13 and therewith the pin 10 in the blocking position of the barrel 1 during the utilization of the weapon.

According to another characteristic of the invention, to the blocking pin 10, and more precisely to its semi-cylindrical portion 11, there is associated (see FIGS. 6 and 7) a relatively small lever 17 which has an arresting tooth 18 both of which serve to engage the semi-cylindrical portion 11 and the notch 12, respectively, of the pin 10 whenever the pin 10 is rotated with the lever 13 into the blocking position of the barrel 1' and the barrel 1 is separated from the weapon itself. For this purpose, the small lever 17 is actuated by a torsion spring 19 which is capable of displacing the lever 17 toward the pin 10. The lever 17 is also displaceable away from the pin 10 in opposition to the force of the spring 19, by means of the breech 2 of the barrel 1, when the barrel 1 is applied or attached to the weapon.

Figure 6:
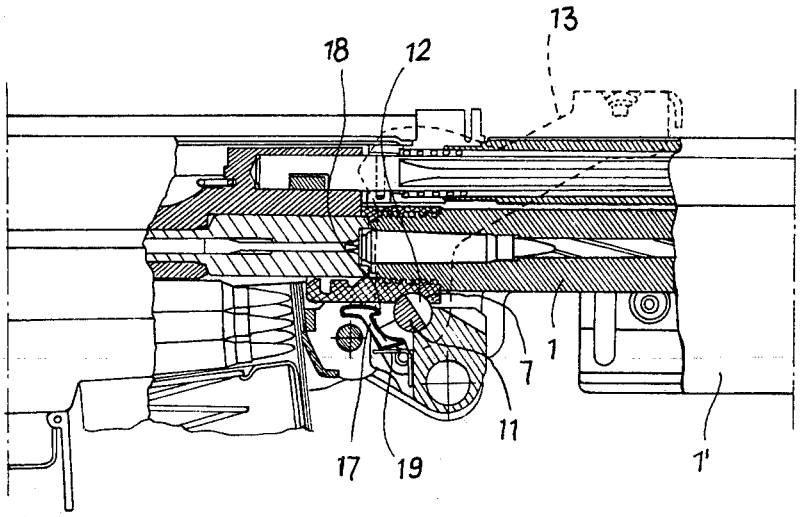
FIG. 6 is a fragmentary side elevational view, partially in section, of the weapon with the barrel blocked in a use position.

FIGS. 1, 3 and 6 of the accompanying drawings show the conditions or position of blocking or blockage of the barrel 1 with respect to the remainder of the weapon for the utilization thereof. In these Figures it can be seen how the arresting lever 17 is moved by the blocking pin 10 through the breech 2 of the barrel 1 and how the maneuver lever 13 is rotated forwardly so as to result in its terminal portion 15 being parallel to and near the frame 3. In this position, the pin 10 is rotated so as to have its full portion 11 engage the semi-cylindrical seat 7 of the breech 2 so as to prevent any axial movement of the barrel 1. The weapon may thus be utilized with the upper terminal portion 15 of the lever 13 being lowered onto the frame 3 so as to permit the aiming of the weapon, while the cam portion 14 of the lever 13 becomes spaced from the handle 5 of the carriage 4 so as not to be an obstacle to the normal functioning of the carriage 4.

Figure 7:
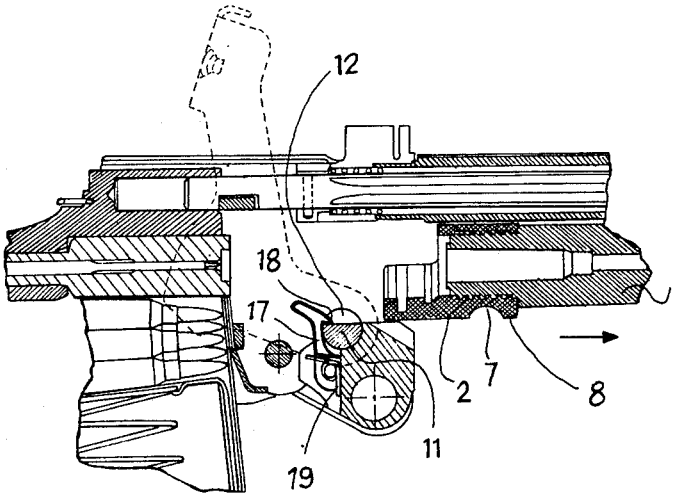
FIG. 7 is a sectional view similar to that of FIG. 6 but with the barrel unblocked for its disassembling.

For the mounting or assembling of the barrel 1 it is sufficient to displace the lever 13 so as to rotate the blocking pin 10 and to dispose its notch 12 facing toward the base of the breech 2 of the barrel 1 as shown in FIGS. 4 and 7 of the drawings.

With backward displacement of the lever 13 the cam portion 14 of the lever 13 moves against the handle 5 of the carriage 4 causing the rearward displacement thereof.

In these conditions, the barrel 1 can be disassembled from the weapon, simply by displacing it forwardly in the axial direction, that is to say, in the direction of the arrow F of FIG. 4. With the separation of the barrel 1, the arresting lever 17, urged by its respective spring 19, is displaced so as to cause engagement of the tooth 18 thereof with the portion 11 of the pin 10. This prevents the rotation of the pin 10 itself and therefore prevents rotation of the lever 13, so that the weapon is always in condition to rapidly and simply accept a fresh barrel 1. Furthermore, since the rotation of the lever 13 is prevented the advancement of the carriage 4 and therefore the complete advancement of the firing pin of the weapon is also prevented, because the handle 5 of the carriage 4 is forced into the rearward position by the maneuver lever 13.

Thus, when the barrel 1 is disassembled, it is possible to immediately assemble a new barrel 1 in substitution for the first one.

Also the assembly of a fresh barrel 1 is executed with a simple linear or axial displacement thereof, effected in a sense or direction inverse to that of disassembling. The operations of assembly and disassembly of the barrel 1 can thus be effected without the user being compelled to alter or modify whatever the normal conventional firing position.

Once the new barrel 1 is inserted, the lever 13 must be rotated into the closing position corresponding to FIGS. 1 and 3 of the accompanying drawings, so that the pin 10 blocks the breech 2 with its semi-cylindrical portion 11, as presented in FIG. 6.

If this closing maneuver just described is not excecuted by the user, the lever 13 always prevents the advancement of the carriage 4 and therefore the utilization of the weapon. On the other hand, the terminal portion 15 of the lever 13, which is interposed between the aiming points of the weapon, prevents the aiming of the weapon so that the user is automatically alerted to the erroneous operating condition.

When the displacement of the lever 13 is incomplete, and depending on the intermediate position assumed thereby, there are two possibilities:

(a) If the handle 5 of the carriage 4 is aligned with the curved portion 14' of the cam portion 14 of the lever 13, regardless of any pushing force by the handle 5 on the curved portion 14', no rotation of the lever 13 can take place so that the use of the weapon is fully prevented and in this case the upper terminal 15 of the lever 13 prevents the user from aiming the weapon.

(b) If on the other hand the handle 5 of the carriage 4 is positioned such so as to act on the flat portion 14" of the cam portion 14 of the lever 13, then the force of the handle 5 being pushed against the flat portion 14" tends to carry the lever 13 and the pin 10 to the closing position, thus obtaining the blocking of the barrel 1 for the utilization of the weapon.

I claim:

1. A lever-type closing device for the blocking and unblocking of the barrel of an automatic, portable weapon having a carriage with a holding handle protruding from a side of the weapon, said closing device comprising a blocking pin which rotates about its own axis and which has a semi-cylindrical portion defined by a notch, a maneuver lever mounted for rotation on said pin, said pin being mounted transversely on the frame of the weapon so as to engage a semi-cylindrical seat provided at the base of the breech of the barrel for blocking and unblocking the barrel, said maneuver lever being on a side of the weapon forward of said handle of said carriage, characterized in that said maneuver lever has a cam portion which acts against said handle to maintain said carriage in a relatively rearward position when said lever is in the unblocking position of the barrel, said cam portion having a curved section that is concentric with the axis of said pin so that movement of said handle on said curved section does not cause rotation of said lever, said cam portion further including a flat section which, when subjected to a force applied thereto by said handle, tends to move said lever to a position blocking said barrel.

2. The lever-type closing device according to claim 1 wherein a pivotally mounted, arresting lever cooperates with said semi-cylindrical portion of the blocking pin for blocking said pin and said maneuver lever when said pin and said lever are rotated into an opening position of the barrel, said lever having a tooth capable of engaging said semi-cylindrical portion and being displaceable towards said semi-cylindrical portion by a spring when said barrel is disassembled and in an opposite direction when said barrel is assembled on the weapon.

3. The lever-type closing device according to claim 1, in which said barrel is axially displaceable on the weapon and is assembled and disassembled to and from the weapon by axial displacement of said barrel.

4. The lever-type device according to claim 1, wherein the weapon has aiming points and said maneuver lever has an upper terminal portion that is interposed between the aiming points of the weapon when said lever is rotated to one of a total unblocking position and a partial unblocking position of the barrel.

* * * * *